US008639143B2

(12) United States Patent
Fukuda et al.

(10) Patent No.: US 8,639,143 B2
(45) Date of Patent: Jan. 28, 2014

(54) FIXING DEVICE AND IMAGE FORMING APPARATUS

(75) Inventors: Yuichi Fukuda, Kanagawa (JP); Takahito Chiba, Kanagawa (JP); Sho Watanabe, Kanagawa (JP); Masayuki Kono, Kanagawa (JP); Tomoyuki Ito, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 407 days.

(21) Appl. No.: 12/706,733

(22) Filed: Feb. 17, 2010

(65) Prior Publication Data

US 2011/0064438 A1 Mar. 17, 2011

(30) Foreign Application Priority Data

Sep. 14, 2009 (JP) ..... 2009-212042

(51) Int. Cl.
*G03G 15/20* (2006.01)

(52) U.S. Cl.
USPC ..... 399/68

(58) Field of Classification Search
USPC ..... 399/68
See application file for complete search history.

(56) References Cited

U.S. PATENT DOCUMENTS

| | | | | |
|---|---|---|---|---|
| 5,729,818 | A | 3/1998 | Ishizuka et al. | |
| 5,828,939 | A * | 10/1998 | Yoshiuchi et al. | 399/388 |
| 2007/0048035 | A1* | 3/2007 | Baba et al. | 399/323 |
| 2008/0013992 | A1 | 1/2008 | Fukuhata et al. | |
| 2009/0035034 | A1 | 2/2009 | Nagase | |
| 2009/0208236 | A1* | 8/2009 | Katsura et al. | 399/68 |
| 2010/0196036 | A1* | 8/2010 | Nakajima | 399/68 |

FOREIGN PATENT DOCUMENTS

| | | | |
|---|---|---|---|
| JP | 59-212865 | A | 12/1984 |
| JP | 5-134499 | A | 5/1993 |
| JP | 8-179636 | A | 7/1996 |
| JP | 2003302858 | A | 10/2003 |
| JP | 2004331311 | A | 11/2004 |
| JP | 2006-227486 | A | 8/2006 |
| JP | 2007-4117 | A | 1/2007 |
| JP | 2007-65082 | A | 3/2007 |
| JP | 2007199342 | A | 8/2007 |
| JP | 2007233073 | A | 9/2007 |
| JP | 200936812 | A | 2/2009 |

OTHER PUBLICATIONS

Communication issued Aug. 28, 2012 by the European Patent Office in counterpart European Application No. 10156164.5.
Notification of Reason for Refusal, dated May 14, 2013, issued by the Japanese Patent Office in counterpart Japanese Application No. 2009-212042.

* cited by examiner

*Primary Examiner* — Walter L Lindsay, Jr.
*Assistant Examiner* — Ruth Labombard
(74) *Attorney, Agent, or Firm* — Sughrue Mion, PLLC

(57) ABSTRACT

A fixing device includes: a fixing roll that is rotatable; a belt member that is stretched over the fixing roll; a pressurizing roll that pressurizes the fixing roll via the belt member; a belt pressing member that presses an outer surface of the belt member to the pressurizing roll from inside of the belt member on a downstream side at a pressure-contact position between the fixing roll and the pressurizing roll; and a controller that decrease a time difference between a passage time per unit area of a tip region of a recording medium and a passage time per unit area of a succeeding region of the recording medium to pass a pressure-contact portion between the fixing roll and belt pressing member and the pressurizing roll.

3 Claims, 10 Drawing Sheets

FIXING DEVICE AND IMAGE FORMING APPARATUS

CROSS-REFERENCE TO RELATED APPLICATION

This application is based on and claims priority under 35 USC 119 from Japanese Patent Application No. 2009-212042 filed on Sep. 14, 2009.

BACKGROUND

1. Technical Field

This invention relates to a fixing device and an image forming apparatus.

2. Related Art

In an image forming apparatus such as a copier or a printer, for example, a recording medium with a toner image transferred is subjected to heating and pressurizing to carry out fixing processing of fixing the toner image on the recording medium.

The fixing device employed for the fixing processing is composed of e.g. a belt member which is heated by a heating source such as a heater and also rotatably stretched by a fixing roll, and a pressurizing roll which pressurizes the fixing roll via the belt member. In such a fixing device, a nipping zone of heating and pressurizing the recording medium is formed at a pressure-contact position between the fixing roll and the pressurizing roll; the tone image transferred on the recording medium suffers from the heating and pressurizing operation while the recording medium passes the nipping zone so that it is fixed on the recording medium.

SUMMARY

According to an aspect of the invention, a fixing roll that is rotatable; a belt member that is stretched over the fixing roll; a pressurizing roll that pressurizes the fixing roll across the belt member; a belt pressing member that presses an outer surface of the belt member to the pressurizing roll from inside of the belt member on a downstream side at a pressure-contact position between the fixing roll and the pressurizing roll; and a controller that decrease a time difference between a passage time per unit area of a tip region of a recording medium and a passage time per unit area of a succeeding region of the recording medium to pass a pressure-contact portion between the fixing roll and belt pressing member and the pressurizing roll.

BRIEF DESCRIPTION OF THE DRAWINGS

Exemplary embodiments of the invention will be described in detail based on the following figures, wherein.

DETAILED DESCRIPTION

Now, referring to the attached drawings, a detailed explanation will be given of an exemplary embodiment of this invention.

Additionally, the following description indicates, as examples, members constituting an image forming apparatus to which this exemplary embodiment is applied and the substance, thickness, hardness, etc. of each member; however, without being limited to such a construction, the construction according to a device designing condition such as a using object and an using condition may be adopted.

Figure 1:
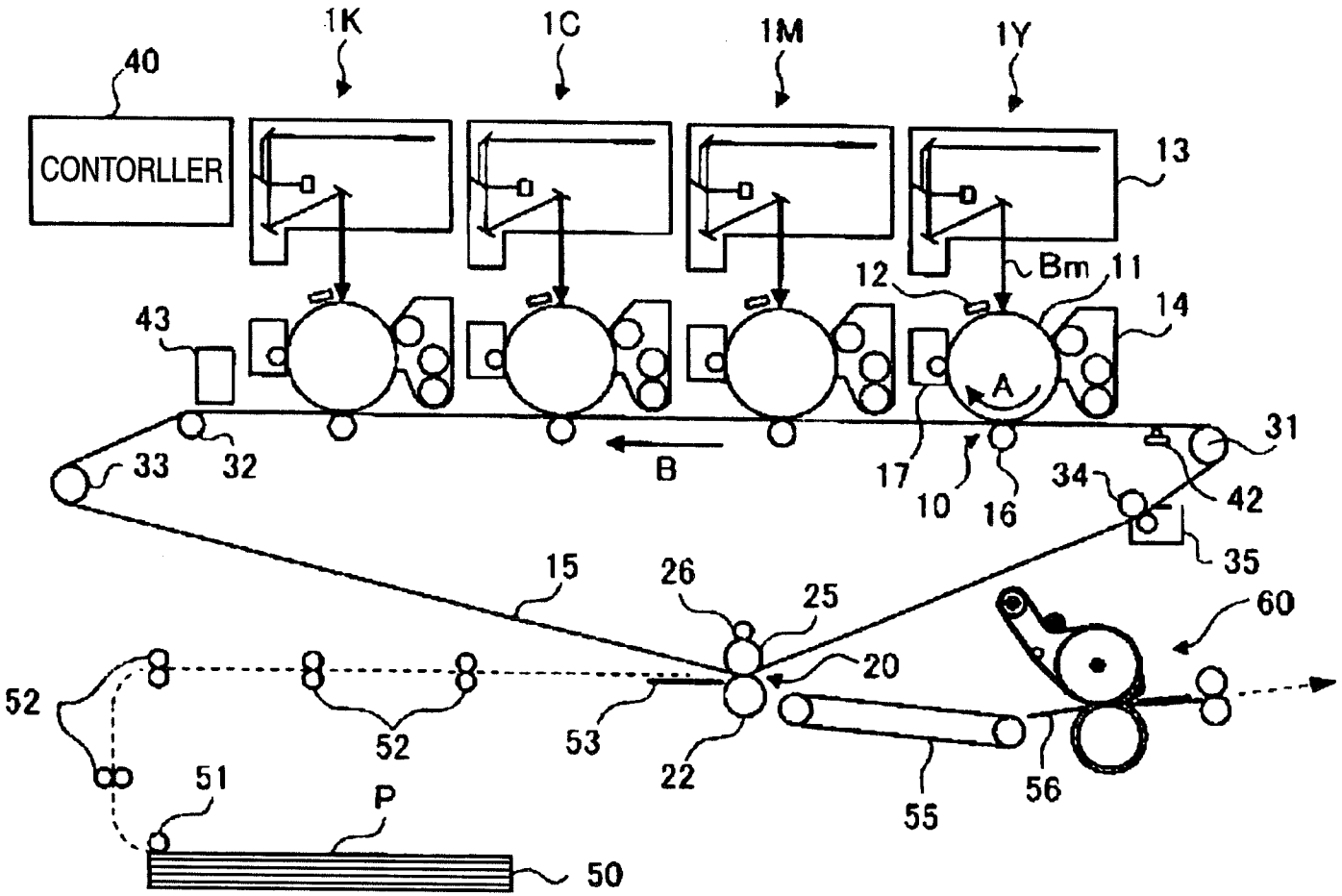
FIG. 1 is a schematic diagram showing an image forming apparatus according to an exemplary embodiment of this invention.

FIG. 1 is a schematic diagram showing an image forming apparatus according to an exemplary embodiment of this invention. The image forming apparatus shown in FIG. 1 is an intermediate transfer system of image forming apparatus generally called "a tandem type". This apparatus includes plural of image forming units 1Y, 1M, 1C, 1K of forming toner images with respective color components through an electrophotographic system; a primary transfer unit 10 for successively transferring the toner images with respective color components formed by the respective image forming units 1Y, 1M, 1C, 1K to an intermediate transfer belt 15 (primary transfer); a secondary transfer unit 20 for collectively transferring a superposed toner image transferred on the intermediate transfer belt 15 onto a sheet P (secondary transfer) which is a recording medium; and a fixing device 60 for fixing the image secondary-transferred on the sheet P. The image forming apparatus also includes a control unit 40 for controlling the operation of each unit.

In this exemplary embodiment, successively arranged around a photoconductor 11 rotating in the direction of arrow A in each of the image forming units 1Y, 1M, 1C and 1K are various devices for electrophotography such as a charger 12 which charges the photoconductor 11, a laser exposure device 13 which writes an electrostatic latent image on the photoconductor 11 (in the figure, an exposure beam is indicated by symbol Bm), a developer 14 which incorporates the toner with each color component to visualize the electrostatic latent image on the photoconductor 11 using the toner; a primary transfer roll 16 which transfers the toner image with each color component formed on the photoconductor 11 to an intermediate transfer belt 15 through the primary transfer unit 10; and a photoconductor cleaner 17 which removes the toner remaining on the photoconductor 11. These image forming units 1Y, 1M, 1C and 1K are nearly linearly arranged in the order of yellow (Y), magenta(M), cyan (C) and black (K) from the upstream side of the intermediate transfer belt 15.

The intermediate transfer belt 15 which is an intermediate transfer body is made of a film-like endless belt with polyimide or polyamide resin containing a suitable quantity of an anti-static agent such as carbon black. Its volume resistivity ranges from $10^6$ to $10^{14}$ Ωcm. Its thickness is e.g. about 0.1 mm. The intermediate transfer belt 15 is circulation-driven (rotation-run) at a predetermined speed in the direction of arrow B shown in FIG. 1 by various rolls. These various rolls arranged include a driving roll 31 which is driven by a motor (not shown) with excellent capability of constant speed to rotation-run the intermediate transfer belt 15; a supporting roll 32 which supports the intermediate transfer belt 15 nearly linearly extending along the direction of arranging the photoconductors 11; a tension roll 33 which gives definite tension to the intermediate transfer belt 15 and also serves as a meandering preventing roll of preventing the meandering of the intermediate transfer belt 15; a backup roll 25 which is provided at the secondary transfer unit 20 so as to serve as a supporting roll of supporting the intermediate transfer belt 15 from behind; and a cleaning backup roll 34 which serves as a supporting roll provided at a cleaning unit scraping the remaining toner on the intermediate transfer belt 15.

The primary transfer unit 10 is constructed of primary transfer rolls 16 which are arranged oppositely to the photoconductors 11 across the intermediate transfer belt 15. The primary transfer roll 16 is composed of a shaft and a sponge layer which is an elastic layer fixed to the periphery thereof. The shaft is a cylindrical rod made of a metal such as iron or SUS. The sponge layer is a sponge-like cylindrical roll made of a blended rubber of NBR, SBR and EPDM mixed with a conducting agent such as carbon black and having a volume resistivity of $10^7$ to $10^9$ Ωcm. The primary transfer roll 16 is arranged in pressure-contact with the photoconductor 11 across the intermediate transfer belt 15. Further, the primary transfer roll 16 is supplied with a voltage (primary transfer bias) with a polarity opposite to the toner charging polarity (defined as a minus polarity, and ditto for the following description). Thus, the toner images on the respective photoconductors 11 are successively electro-statically sucked on the intermediate transfer belt 15 so that the superposed toner image is formed on the intermediate transfer belt 15.

The secondary transfer unit 20 includes a secondary transfer roll 22 arranged on the side of carrying the toner image of the intermediate transfer belt 15 and a backup roll 25. The backup roll 25 is composed of a tube of blended rubber of EPDM and NBR dispersed with carbon in the surface and an EPDM rubber in the interior. The backup roll 25 is formed to have a surface resistivity of $10^7$ to $10^{10}$Ω/□ and a hardness of 70° (asker C). The backup roll 25 is arranged on the back side of the intermediate transfer belt 15 and serves as an opposite electrode for the secondary transfer roll 22; a metallic power supply roll 26 to which a secondary transfer bias is stably applied is arranged adjacently thereto.

On the other hand, the secondary transfer roll 22 is composed of a shaft and a sponge layer which is an elastic layer fixed to the periphery thereof. The shaft is a cylindrical rod made of a metal such as iron or SUS. The sponge layer is a sponge-like cylindrical roll made of a blended rubber of NBR, SBR and EPDM mixed with a conducting agent such as carbon black and having a volume resistivity of $10^7$ to $10^9$ Ωcm. The secondary transfer roll 22 is arranged in pressure-contact with the backup roll 25 across the intermediate transfer belt 15. Further, the secondary transfer roll 22 is grounded to form a secondary transfer bias between itself and the backup roll 25 so that the toner image is secondary-transferred onto the sheet P transported to the secondary transfer unit 20.

Further, on the downstream side of the secondary transfer unit 20 of the intermediate transfer belt 15, a belt cleaner 35 is separatably/contactably provided which removes the remaining toner or paper powder on the intermediate transfer belt 15 after secondary transfer thereby to clean the surface of the intermediate transfer belt 15. On the other hand, on the upstream side of the yellow image forming unit 1Y, a reference sensor (home position sensor) 42 is arranged which generates a reference signal of taking an image forming timing in each image forming unit 1Y, 1M, 1C, 1K. Further, on the downstream side of the black image forming unit 1K, an image density sensor 43 is arranged which adjusts the image quality. The reference sensor 42, when it recognizes a specific mark formed on the back side of the intermediate transfer belt 15, generates the reference signal. By an instruction issued from the control unit 40 on the basis of recognition of the reference signal, each image forming unit 1Y, 1M, 1C, 1K starts image formation.

Further, the image forming apparatus according to this exemplary embodiment includes, as a sheet transporting system, a sheet accommodating unit 50 which accommodates sheets P; a pickup roll 51 which takes out one of the sheets P stacked in the sheet accommodating unit 50 at a timing instructed by the control unit 40 and transport it; transporting rolls 52 which transport the sheet P taken out by the pickup roll 51; a sheet transporting path 53 which sends the sheet transported by the transporting roll 52 into the secondary transfer unit 20; a transporting belt 55 which transports the sheet P transported after secondary-transferred by the secondary transfer roll 22 to the fixing device 60; and a fixing entrance guide 56 which guides the sheet P to the fixing device 60.

Next, an explanation will be given of a basic imaging process in the image forming apparatus according to this exemplary embodiment. In the image forming apparatus as shown in FIG. 1, the image data produced from an image reading device not shown or a personal computer (PC) not shown, after image-processed by an image processing device not shown, are imaged by the image forming units 1Y, 1M, 1C and 1K. In the image processing device, the reflection coefficient data inputted are subjected to the image processing such as shading correction, displacement correction, brightness/color space conversion, gamma correction, frame canceling and various image editions such as color edition or shift edition. The image data image-processed are converted into color material tone data of four colors of Y, M, C and K, which are in turn sent to the laser exposure device 13.

In the laser exposure device 13, according to the color material tone data inputted, the exposure beam Bm emitted from e.g. a semiconductor laser is applied to each photoconductor 11 of the image forming unit 1Y, 1M, 1C, 1K. In photoconductor 11 of the image forming unit 1Y, 1M, 1C, 1K, its surface is charged by the charger 12 and thereafter scanning-exposed by the laser exposure device 13 to form an electrostatic image. The electrostatic latent image formed is developed by the developer 14 of each image forming unit 1Y, 1M, 1C, 1K as the toner image of each color of Y, M, C, K.

In the primary transfer unit 10 where each photoconductor 11 and intermediate transfer belt 15 are kept in contact, the toner image formed on the photoconductor 11 of the image forming unit 1Y, 1M, 1C, 1K is transferred onto the intermediate transfer belt 15. More specifically, in the primary transfer unit 10, a voltage having a polarity (plus polarity) opposite to the charging polarity of the toner (primary transferbias) is applied to the base material of the intermediate transfer belt 15 so that the toner images are successively superposed on the surface of the intermediate transfer belt 15 to carry out the primary transfer.

After the toner images are successively primary-transferred onto the surface of the intermediate transfer belt 15, the intermediate transfer belt 15 is moved so that the toner images are transported to the secondary transfer unit 20. In synchronism with the timing when the toner images are transported to the secondary transfer unit 20, in the sheet transporting system, the pickup roll 51 is rotated so that the sheet P having a size instructed by the control unit 40 is supplied from the sheet accommodating unit 50. The sheet P supplied from the pickup roll 51 is transported by the transporting rolls 52 and reaches the secondary transfer unit 20 via the sheet transporting path 53. Before reaching the secondary transfer unit 20, the sheet P is temporarily stopped and the sheet P and the toner images are aligned with each other in such a manner that a resist roll (not shown) is rotated in synchronism with the moving timing of the intermediate transfer belt 15 holding the toner images.

In the secondary transfer unit 20, the secondary transfer roll 22 is pressed onto the backup roll 25 through the intermediate transfer belt 15. At this time, the sheet P transported timely is sandwiched between the intermediate transfer belt 15 and the secondary transfer roll 22; in this case, if a voltage having the same polarity (minus polarity) as the charging polarity of the toner (secondary transfer vias) is applied to the intermediate transfer belt 15 from the power supply roll 26, a transfer electric field is formed between the secondary transfer roll 22 and the backup roll 25. The non-fixed toner images held on the intermediate transfer belt 15 are collectively electrostatically transferred onto the sheet P in the secondary transfer unit 20 where the secondary transfer roll 22 is pressed onto the backup roll 25.

Thereafter, the sheet P with the tone images electrostatically transferred is transported while being separated from the intermediate transfer belt 15 by the secondary transfer roll 22 and further transported to a transporting belt 55 provided on the downstream side of the sheet transporting direction of the secondary transfer roll 22. In the transporting belt 55, in synchronism with the transporting speed in the fixing device 60, the sheet P is transported to the fixing device 60 at an optimum transporting speed. The non-fixed images on the sheet P transported to the fixing device 60 are subjected to the fixing processing by heat and pressure so that they are fixed on the sheet P. The sheet P with the fixed images is transported to an ejected sheet accommodating unit not shown provided in an ejecting unit of the image forming apparatus.

On the other hand, the residual toners left on the intermediate transfer belt 15, after the transfer onto the sheet P has been completed, are transported in tandem with the rotation-running of the intermediate transfer belt 15 and removed from the intermediate transfer belt 15 by a cleaning backup roll 34 and the intermediate transfer belt cleaner 35.

Next, an explanation will be given of the fixing device 60 employed in the image forming apparatus according to this exemplary embodiment.

Figure 2:
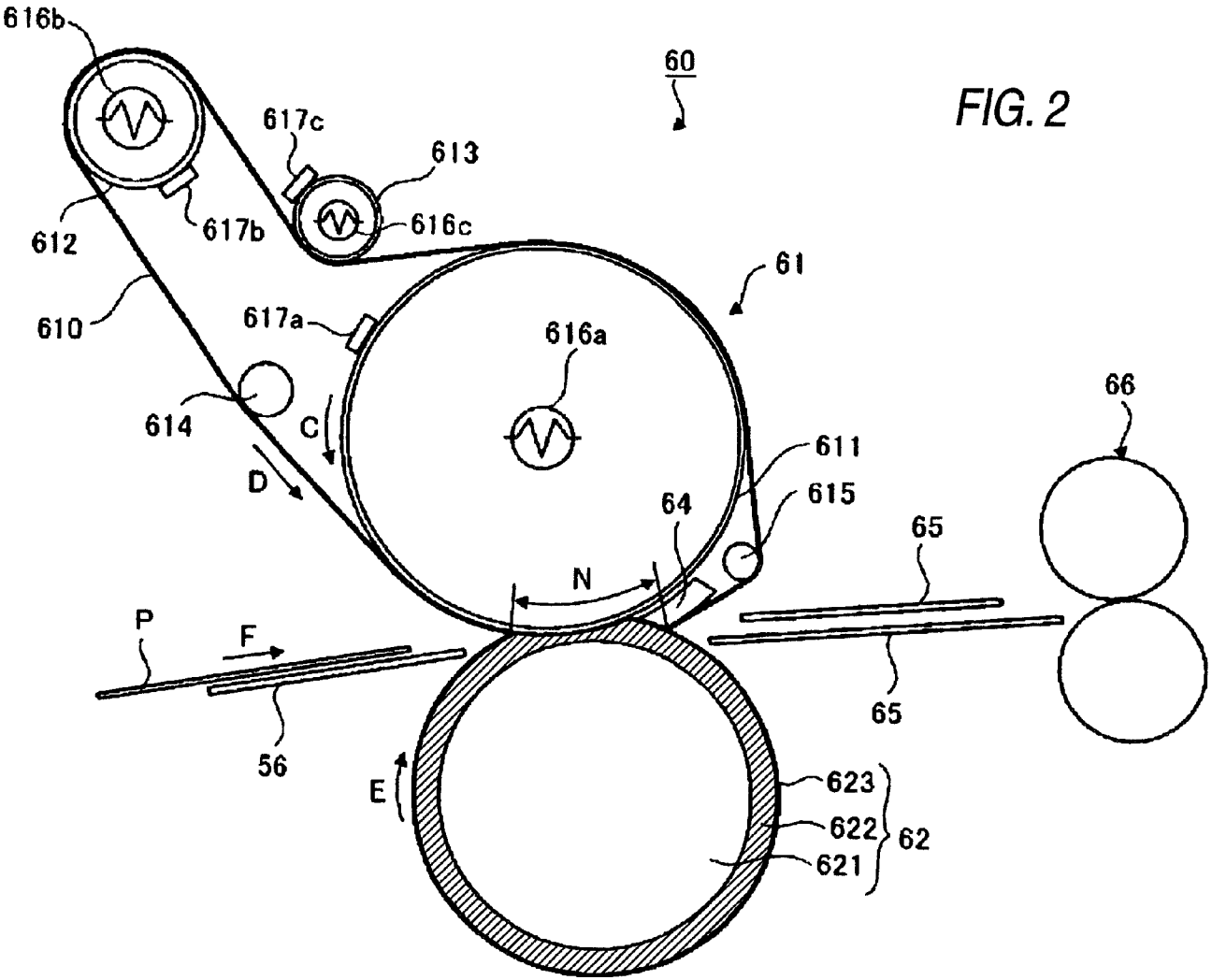
FIG. 2 is a side sectional view showing a schematic configuration of a fixing device according to an exemplary embodiment of this invention.

FIG. 2 is a side sectional view showing a schematic configuration of the fixing device 60 according to this exemplary embodiment. The fixing device 60 includes, as main components, a fixing belt module 61 and a pressurizing roll 62 arranged in pressure-contact therewith.

The fixing belt module 61 includes, as a typical configuration, a fixing belt 610 which is an example of the belt member rotating in a direction of arrow D; a fixing roll 611 which is rotation-driven while stretching the fixing belt 610; a stretching roll 612 which stretches the fixing belt 610 from inside; a stretching roll 613 which stretches the fixing belt 610 from outside; a posture correcting roll 614 which corrects the posture of the fixing belt 610 between the fixing roll 611 and the stretching roll 612; a peeling pad 64 which is an exemplary belt pressing member, in a downstream region within a nipping zone N where the fixing belt module 61 and the pressurizing roll 62 are in pressure-contact with each other, arranged in the vicinity of the fixing roll 611; and a stretching roll 615 which stretches the fixing belt 610 on the downstream side of the nipping zone N.

The fixing belt 610 is a flexible endless belt having a circumferential length of 314 mm and a width of 340 mm. The fixing belt 610 is structured in a multiple layer composed of a base layer of polyimide resin having a thickness of 80 μm, an elastic layer of silicone rubber having a thickness of 200 μm which is laminated on the surface side of the base layer (outer peripheral side) and a releasing layer of tetrafluoroethylene-perfluoroalkylvinylether copolymer resin (PFA) tube having a thickness of 30 μm which is formed on the elastic layer. Now, the elastic layer is provided to improve the image quality of particularly a color image.

The fixing roll 611 is a cylindrical roll of aluminum having an outer diameter of 65 mm, a length of 360 mm and a thickness of 10 mm. The fixing roll 611 rotates in a direction of arrow C at a surface speed of 445 mm/s by driving force from a driving motor not shown.

Inside the fixing roll 611, a halogen heater 616*a* serving as a heating source having a rating of 900 W is arranged. A temperature sensor 617*a* is arranged in contact with the surface of the fixing roll 611. On the basis of a measured value of the temperature sensor 617*a*, the control unit 40 (see FIG. 1) of the image forming apparatus controls the surface temperature of the fixing roll 611 at 150° C.

The stretching roll 612 is a cylindrical roll of aluminum having an outer diameter of 30 mm, a wall thickness of 2 mm and a length of 360 mm. Inside the stretching roll 612, a halogen heater 616*b* serving as a heating source having a rating of 1000 W is arranged. By means of a temperature sensor 617*b* and the control unit (see FIG. 1), the surface temperature of the stretching roll 612 is controlled at 190° C. The stretching roll 612, therefore, has a function of heating the fixing belt 610 as well as the function of stretching the fixing belt 610.

Further, at both ends of the stretching roll 612, spring member (not shown) are arranged to press the fixing belt 610 outwardly to set the entire tension of the fixing belt 610 at 15 kgf. In this case, in order to make uniform the tension of the fixing belt 610 in the width direction and minimize a displacement in the axial direction of the fixing belt 610, the stretching roll 612 is formed in a "crown shape" with the center being larger than the end by 100 μm in their outer diameter.

The stretching roll 613 is a cylindrical roll of aluminum having an outer diameter of 25 mm, a wall thickness of 2 mm and a length of 360 mm. The surface of the stretching roll 613 is covered with PFA having a thickness of 20 μm as a releasing layer. The releasing layer is formed in order to prevent slight offset toner or paper powder produced from the outer surface of the fixing belt 610 from being deposited on the stretching roll 613. Like the stretching roll 612, the stretching roll 613 is also formed in a "crown shape" with the center being larger than the end by 100 μM in their outer diameter. Incidentally, both stretching roll 612 and stretching roll 613 may be formed in the crown shape, or either one thereof may be formed in the crown shape.

Inside the stretching roll 613, a halogen heater 616*c* serving as a heating source having a rating of 1000 W is arranged. By means of a temperature sensor 617*c* and the control unit 40 (see FIG. 1), the surface temperature of the stretching roll 613 is controlled at 190° C. The stretching roll 613, therefore, has a function of heating the fixing belt 610 from the outer surface as well as the function of stretching the fixing belt 610. Thus, in this exemplary embodiment, the fixing belt 610 will be heated by the fixing roll 611, stretching roll 612 and stretching roll 613.

The posture correcting roll 614 is a cylindrical roll of aluminum having an outer diameter of 15 mm and a length of 360 mm. In the vicinity of the posture correcting roll 614, a belt edge position detecting mechanism (not shown) is arranged to detect the edge position of the fixing belt 610. The posture correcting roll 614 is provided with an axial displacing mechanism of displacing the axial contact position of the fixing belt 610 according to the detection result of the belt edge position detecting mechanism thereby to control the meandering (belt-walk) of the fixing belt 610.

The peeling pad 64 is a block member of e.g. a rigid body of metal such as SUS or resin having a nearly arc shape in section. The peeling pad 64 is fixedly arranged over the axial entire region of the fixing roll 611 at the position in the vicinity on the downstream side of a region where the pressurizing roll 62 is in pressure-contact with the fixing roll 611 across the fixing belt 610 (referred to as a "roll-nipping zone N1", see FIG. 3). Further, the peeling pad 64 is arranged to press the pressurizing roll 62 through the fixing belt 610 over a certain width region (e.g. width of 2 mm along the traveling direction of the fixing belt 610) with a predetermined load (e.g. an average of 10 kgf) thereby to form a "roll-nipping zone N2" described below (see FIG. 3).

The stretching roll 615 is a cylindrical roll of aluminum having an outer diameter of 12 mm and a length of 360 mm. The stretching roll 615 is arranged in the vicinity on the downstream side in the traveling direction of the fixing belt 610 of the peeling pad 64 so that the fixing belt 610 having passed the peeling pad 64 smoothly rotation-runs toward the fixing roll 611.

The pressurizing roll 62 is composed of a base material of a cylindrical roll 621 of aluminum having a diameter of 45 mm and a length of 360 mm, and an elastic layer 622 of silicone rubber with rubber hardness of 30° (JIS-A) and a releasing layer 623 of a PFA tube having a film thickness of 100 μm which are laminated in order from the base material side. The pressurizing roll 62 is arranged to pressurize the fixing belt module 61 and rotates in a direction of arrow E to follow the fixing roll 611 in tandem with the rotation in arrow C of the fixing roll 611 of the fixing belt module 61. The traveling speed thereof is 445 mm/s which is equal to the surface speed of the fixing roll 611.

Next, an explanation will be given of the nipping zone N where the fixing belt module 61 and pressurizing roll 62 are in pressure-contact with each other.

Figure 3:
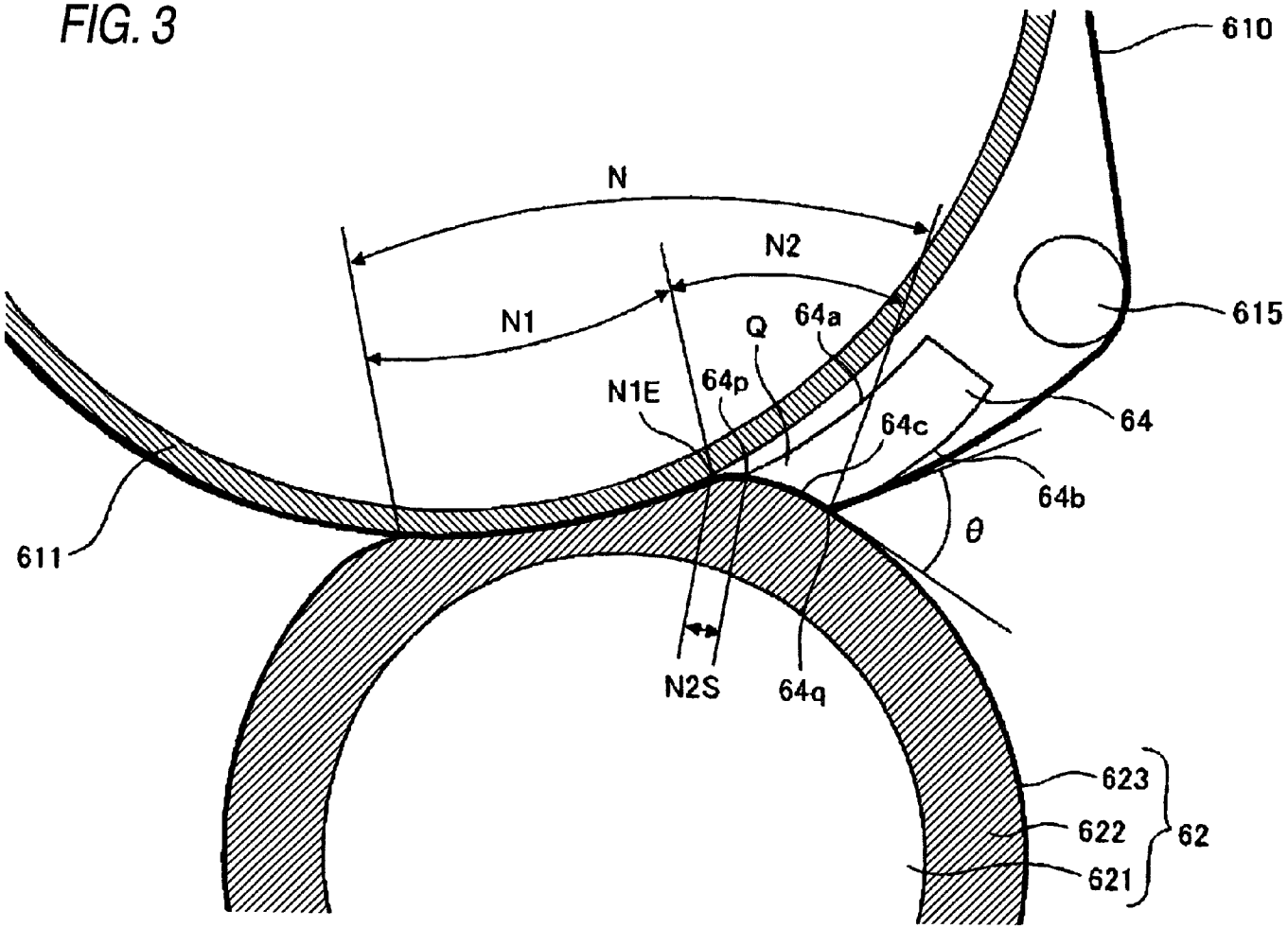
FIG. 3 is a schematic sectional view showing a region in the vicinity of a nipping zone according to an exemplary embodiment of this invention.

FIG. 3 is a schematic sectional view showing a region in the vicinity of the nipping zone N. As seen from FIG. 3, in the nipping zone N where the fixing belt module 61 and the pressurizing roll 62 are in pressure-contact with each other, within the zone (wrapped zone) where the fixing belt 610 is wrapped around the fixing roll 611, the pressurizing roll 62 is arranged in pressure contact with the outer peripheral surface of the fixing belt 610 thereby to form the roll-nipping zone (first nipping zone) N1.

Now, in the fixing device 60 according to this exemplary embodiment, as described above, the fixing roll 611 is formed of a hard roll of aluminum whose surface is relatively hard and the pressuring roll 62 is formed of a soft roll, which is covered with the elastic layer 622 whose surface is relatively soft. For this reason, in the roll-nipping zone N1, the fixing roll 611 suffers from hardly any dent and only the surface of the pressurizing roll 62 is greatly dented (the amount of dent in the pressurizing roll 62>the amount of dent in the fixing roll 611). In this way, the nipping zone having a width in the traveling direction of the fixing belt 610 is formed.

Thus, in the fixing device 60 according to this exemplary embodiment, the fixing roll 611 on the side where the fixing belt 610 is wrapped in the roll-nipping zone N1 is not almost deformed to keep its cylindrical shape. The fixing belt 610, therefore, rotation-runs along the circumferential surface of the fixing roll 611 without varying its running radius. Thus, the fixing belt 610 may pass the roll-nipping zone N1 while keeping a constant running speed. Accordingly, also when the fixing belt 610 passes the roll-nipping zone N1, wrinkles or deformation in the fixing belt 610 is very hard to occur. As a result, it is possible to prevent disorder of the fixed image, thereby stably providing the fixed image with excellent quality. Incidentally, in the fixing device 60 according to this exemplary embodiment, the roll-nipping zone N1 is set at a width of 15 mm along the traveling direction of the fixing belt 610.

In the vicinity on the downstream side of the roll-nipping zone N1, the peeling pad 64 is arranged which presses the fixing belt 610 onto the pressurizing roll 62 surface. Thus, in succession to the roll-nipping zone N1, a peeling-pad nipping zone (second nipping zone) N2 is set where the fixing belt 610 is wrapped around the pressurizing roll 62 surface.

As shown in FIG. 3, the peeling pad 64 providing the peeling-pad nipping zone N2 is formed in a nearly arc-shape in section. For this reason, the fixing belt 610 having passed the peeling-pad nipping zone N2 moves to follow the peeling pad 64 so that its traveling direction abruptly changes to warp toward the stretching roll 615. Thus, the sheet P having passed the roll-nipping zone N1 and the peeling-pad nipping zone N2 is peeled from the fixing belt 610 at the time when it departs from the peeling-pad nipping zone N2, thereby stably executing curvature separation for the sheet P. Incidentally, in the fixing device 60 according to this exemplary embodiment, the peeling-pad nipping zone N2 is set at a width of 2.5 mm along the traveling direction of the fixing belt 610.

Figure 4:
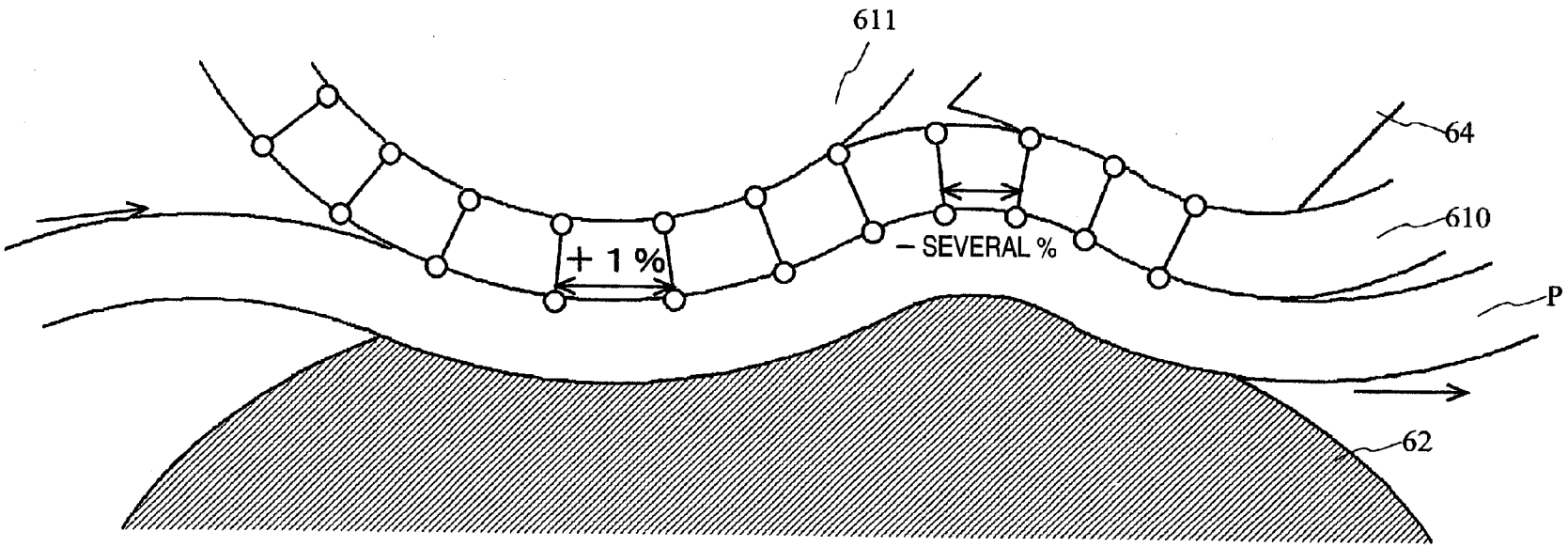
FIG. 4 is a view for explaining the mechanism of generating a gloss difference (hypothesis)
Figure 5:
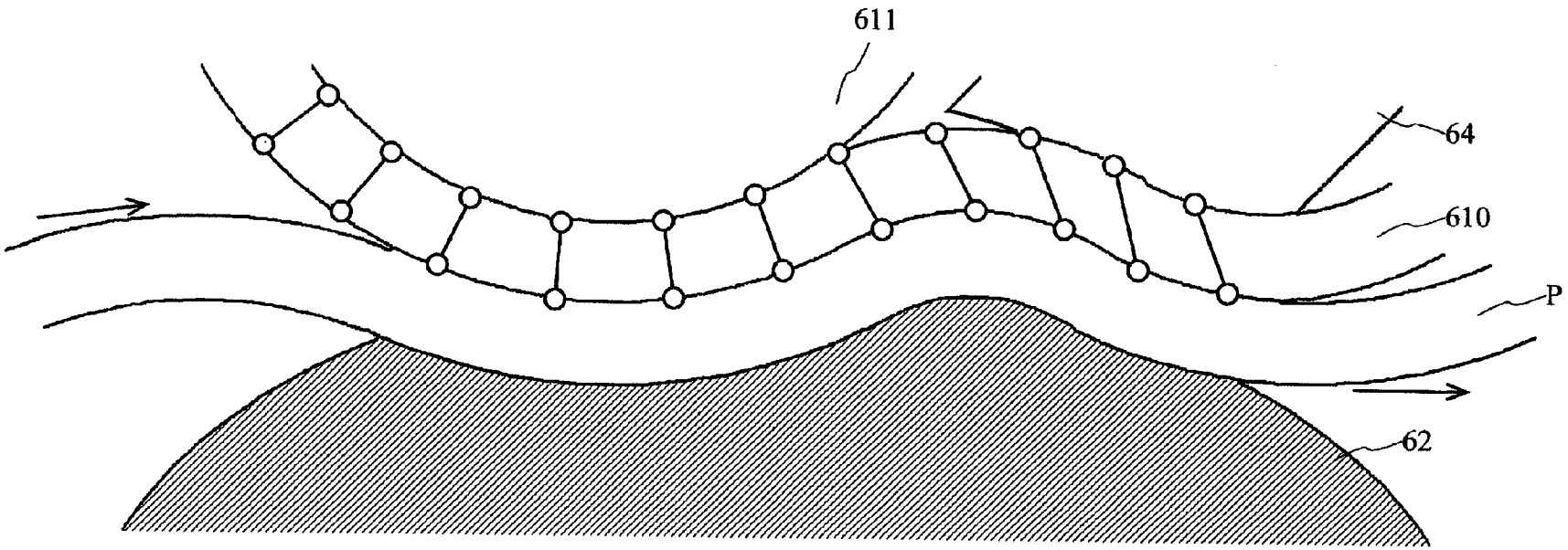
FIG. 5 is a view for explaining the mechanism of generating a gloss difference (hypothesis)
Figure 6:
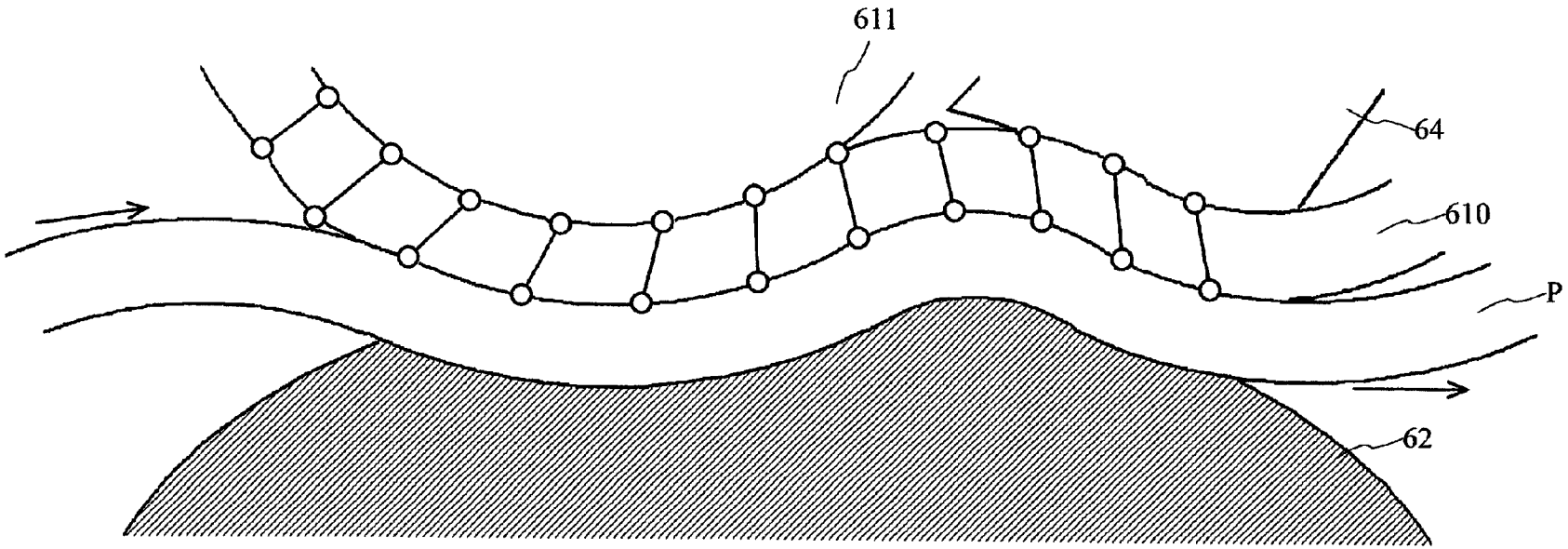
FIG. 6 is a view for explaining the mechanism of generating a gloss difference (hypothesis)

Meanwhile, in the fixing processing using the fixing device 60 as described above, as the case may be, the tip region of the sheet P provides a higher gloss than the succeeding region to generate a gloss difference therebetween. The mechanism (hypothesis) of generating such a gloss difference will be explained referring to FIGS. 4 to 6. FIGS. 4 to 6 represent a manner of deformation of the fixing belt 610 by connecting the corresponding positions of the outer surface of the fixing belt 610 and the rear surface thereof by connecting lines.

Where the fixing belt 610 and the sheet P are placed in a free state (slippery for each other), it is assumed that the fixing belt 610 is deformed in the shape as shown in FIG. 4. Specifically, in the region along the fixing roll 611, the outer surface of the fixing belt 610 is extended more greatly than the rear surface thereof by e.g. about 1%, whereas in the region along the peeling pad 64, the outer surface of the fixing belt 610 is contracted more greatly than the rear surface thereof by several %.

Additionally, in the nipping zone N, the sliding stress applied to the fixing belt 610 by the toner on the sheet P owing to the pressing from the pressurizing roll 62 is enough to sharing-deform the elastic layer of the fixing belt 610 (in this example, LSR (liquid-silicone rubber) layer). If the fixing belt 610 and the sheet P are in a free state (slippery for each other), it is assumed that the quantity of displacement (slippage) in the belt rotating direction (sheet traveling direction) due to slippage becomes 100 μm or more at the maximum, but because the toner image fixed on the sheet P generates no displacement, no slippage will be presumably generated in the region where the toner image is held on the sheet P.

Now, the Young's modulus (longitudinal elastic coefficient) of the sheet P is approximately equal to that of polyimide resin employed in the base layer (rear side) of the fixing belt 610; so if the sheet P is kept in intimate contact with the fixing belt 610 through the toner, the outer surface of the fixing belt 610 travels in an extended state according to the sheet P. Thus, in an S-path of the nipping zone N, the corresponding positions of the outer surface of the fixing belt 610 and the rear surface thereof will be displaced. Accordingly, such shearing deformation as shown in FIG. 5 will be presumably generated in the fixing belt 610. In short, in the region facing the peeling pad 64 (peeling-pad nipping zone N2), the outer surface of the fixing belt 610 precedes the rear surface in the rotating direction.

Such a condition is prone to occur at the tip region of the sheet P and will be gradually cancelled with the traveling (transportation) of the sheet P, which eventually results in a contact balancing state as illustrated in FIG. 6. Namely, in contact balancing state, the outer surface of the fixing belt 610 is displaced onto the upstream side of the roll-nipping zone N1.

Further, a difference in the way of deformation of the fixing belt 610 between the tip region of the sheet P and its succeeding region thereof as described above will presumably lead to a difference in the time taken for the sheet staying in the nipping zone N to be subjected to the fixing processing (nipping zone staying time).

The mechanism as described above (hypothesis) is based on a series of actions of distortion and its absorption occurring in the fixing belt 610 in the S-shape nipping path formed by provision of the peeling pad 64.

Figure 7:
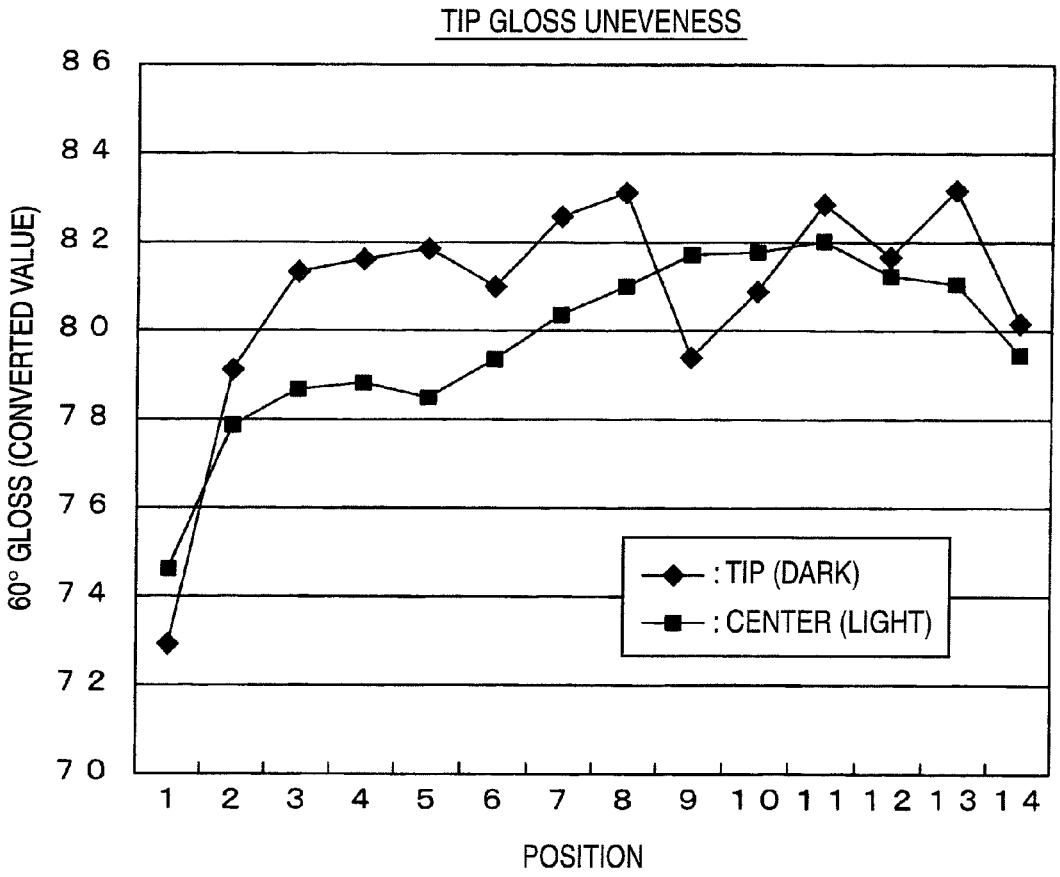
FIG. 7 is a view illustrating gloss values at various positions of a sheet.

It may be supposed that owing to the cause described above and various causes described below, the nipping zone staying time of a certain region of the sheet P becomes longer than the other region so that for example, as illustrated in FIG. 7, the tip region provides a higher gloss than the succeeding region to generate a gloss difference.

With a horizontal axis representing the positions which partition the sheet P in the direction orthogonal to its traveling direction (lateral direction) and a vertical axis representing the gloss values (converted values of 60° gloss) which indicates the degrees of gloss, FIG. 7 illustrates gloss values at the respective positions (lateral positions) of the sheet P for each of the tip region of the sheet P and the central region (an example of the succeeding region) thereof. As seen from FIG. 7, although there are slight variations, the tip region of the sheet P indicates a tendency of indicating a higher gloss value than the central region; thus, it may be seen that the tip region of the sheet P is visually darker to generate the gloss difference. This is attributable to the fact that as a result that the tip region of the sheet P has been fixing-processed for a longer time than the central region thereof, the surface of the toner image at the tip region becomes smooth thereby to suppress irregular reflection of light.

This exemplary embodiment adopts techniques of first to fourth examples described below in order to decrease a time difference of the nipping zone staying time for a unit area between the respective regions of the sheet P (for example, between the tip region and its succeeding region) (to unify the times taken for the fixing processing), thereby suppress occurrence of the gloss difference.

The first example intends to decrease the time difference in the nipping zone staying time which is generated by the following causes.

Specifically, a thicker sheet P suffers from greater braking force at the entrance of the peeling-pad nipping zone N2 so that the nipping staying time of the tip region of the sheet P is prone to become longer than the succeeding region. This is attributable to the fact that at the entrance of the peeling-pad nipping zone N2, the curvature of the nipping path varies in the direction opposite to that in the roll-nipping zone N1 at the previous stage so that when the tip of the sheet P passes this varying zone, the braking force acts according to the strength of the sheet P (generally, it increases as the thickness of the sheet becomes thick).

So, the first structural example is provided with a speed adjusting unit for adjusting the speed of transporting the sheet by the transporting belt 55 (in this example, realized by the control unit 40) which previously makes higher the speed of the tip region of the sheet P entering the nipping zone N (transporting speed before fixing) than a reference speed and thereafter returns it to the reference speed. Specifically, the speed of the tip region of the sheet P entering the nipping zone N is temporarily increased to prevent this speed from being decreased to the reference speed or lower (otherwise to reduce alienation from the reference speed) owing to the braking force at the entrance of the peeling-pad nipping zone N2, thereby decreasing a time difference in the nipping zone staying time between the tip region of the sheet P and its succeeding region. Considering the fact that the thicker the sheet P, the greater the braking force at the entrance of the peeling-pad nipping zone N2, for the sheet which is thicker, the transporting speed before fixing is set at a higher value. Incidentally, the speed adjustment may be also done according to other sheet attributes such as the kind of the sheet or its weight which influence the braking force; considering the degree of speed reduction at the entrance of the peeling-pad nipping zone N2, the speed adjustment has only to be done so that the nipping zone staying time of the tip region of the sheet P becomes approximately equal to that of the succeeding region.

Figure 8:
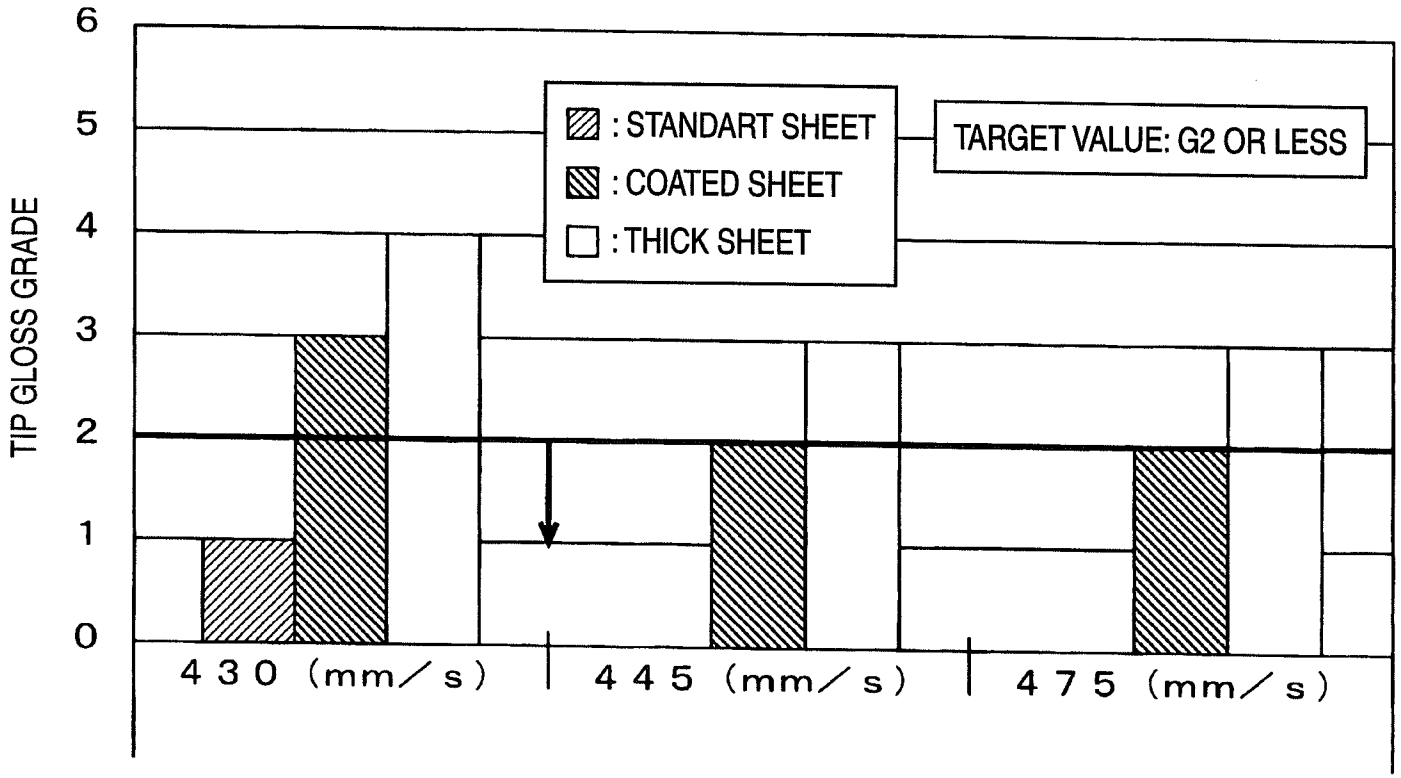
FIG. 8 is a view illustrating the verifying result of a measure of dealing with a gloss difference based on the adjustment of a transporting speed.

FIG. 8 is a graph illustrating the verified result of the measure for dealing with the gloss difference based on adjustment of the transporting speed.

In this example, for the purpose of verification, using the fixing belt 610 having a thickness of 450 μm with the speed being fixed to 445 mm/s, for three kinds of sheets, i.e. an ordinary sheet with 82 gsm, a coated sheet with 210 gsm and a thick sheet with 350 gsm, their transporting speeds before fixing have been adjusted to 430 mm/s, 445 mm/s and 475 mm/s, respectively. The horizontal axis of the graph represents the transporting speed before fixing (mm/s) and the kind of the sheet; the vertical axis of the graph represents the grade (G) indicating the degree of the gloss difference between the tip region of a recording medium and its succeeding region. It may be evaluated that with G being smaller, the gloss difference is suppressed (good). In this example, the target value of G is set at 2 or less.

According to FIG. 8, where the transporting speed before fixing is 430 mm/s, for the ordinary sheet, G=1; for the coated sheet, G=3; and for the thick sheet, G=4 so that only the ordinary sheet could attain the target. By increasing the transporting speed before fixing to 445 mm/s (equal to that of the fixing belt 610), G is improved (reduced) by 1 for the respective sheets so that the coated sheet as well as the ordinary sheet could attain the target. Incidentally, even when the transporting speed before fixing is further increased to 475 mm/s, G did not change.

The second example intends to reduce the time difference in the nipping zone staying time generated by the following causes. Specifically, in the construction in which oil is supplied to the inner face of the fixing belt 610 in order to reduce the sliding load of the peeling pad 64, if the oil is excessively supplied, the transmission of the driving force from the fixing roll 611 (driving roll) to the fixing belt 610 is attenuated so that the time difference in the nipping zone staying time is prone to occur.

Figure 9:
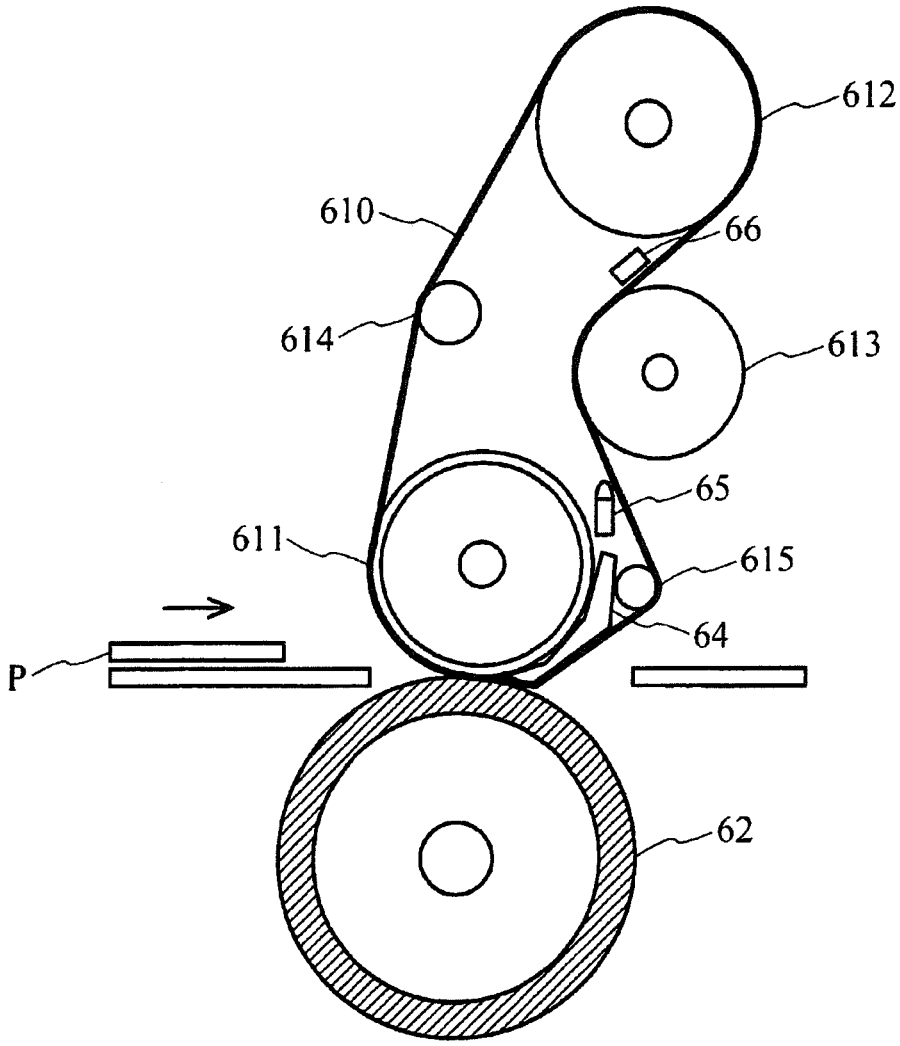
FIG. 9 is a side sectional view showing an exemplary configuration of a fixing device.

In order to obviated such inconvenience, as shown in FIG. 9, the second structural example is provided with an oil supply control unit (in this example, realized by the control unit 40) using an oil-impregnated wick 65 serving as an oil supplying member for supplying an oil to the inner face (rear face) of the fixing belt 610. The oil supply control unit serves to control the oil quantity on the inner face of the fixing belt 610 so that it does not exceed a predetermined reference value. Namely, adjusting the oil quantity on the inner face of the fixing belt brings in balance the braking force at the entrance of the peeling-pad nipping zone N2 and the belt driving force of the fixing belt 610 thereby to realize stabilized belt driving. Thus, even when the sheet P suffering from greater braking force such as the thick sheet has been transported, a time difference in the nipping zone staying time between the tip region of the sheet P and its succeeding region may be decreased. In place of the oil supply control unit or in addition thereto, an oil wiping pad 66 serving as an oil wiping member for wiping the oil on the inner face of the fixing belt 610 may be provided to adjust the oil quantity on the inner face of the fixing belt 610.

Figure 10:
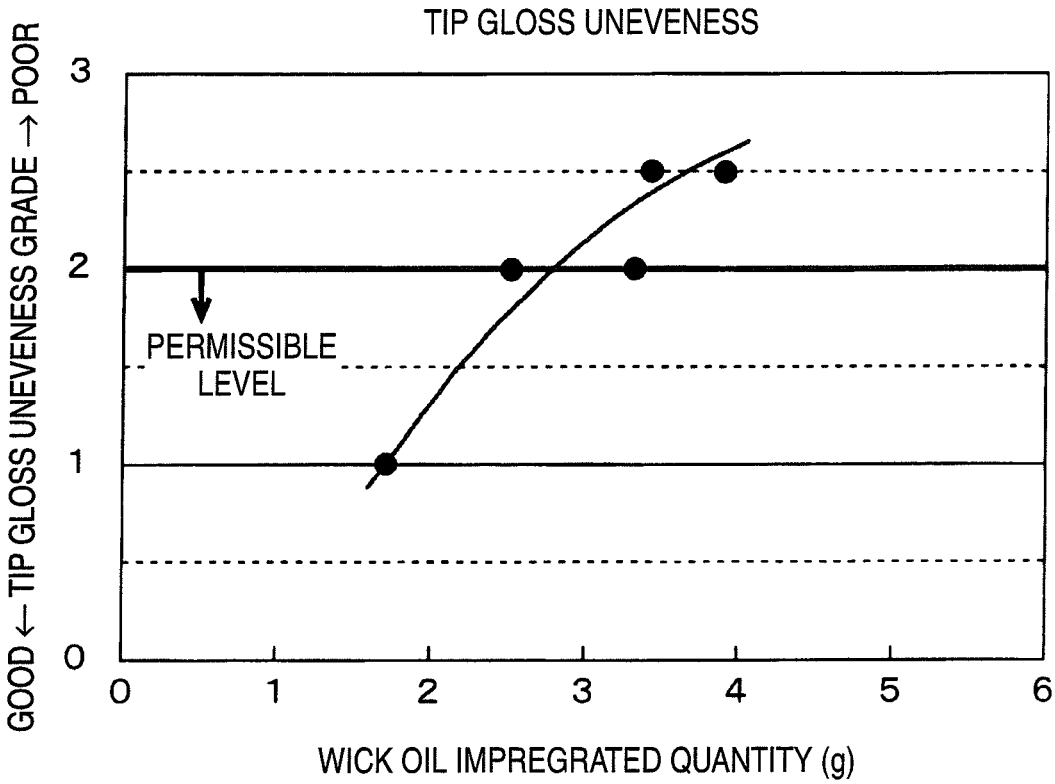
FIG. 10 is a view illustrating the verifying result of a measure of dealing with a gloss difference based on the adjustment of oil supply.

FIG. 10 is a graph illustrating the verified result of the measure for dealing with the gloss difference based on adjustment of the oil quantity.

In this example, for the purpose of verification, using a thick sheet of 350 gsm as the sheet P, four color images with the toners of yellow (Y), magenta (M), cyan (C) and black (K) each having an area ratio of 60% are superposed. As the oil impregnated wick 65, a "polyflon" (PTFE) paper having a hollow structure of an axial length of 330 mm, a width of 22 mm and a thickness of 1 mm is impregnated with an amino-metamorphosed oil. The horizontal axis of the graph represents an oil impregnated quantity (g) of the oil impregnated wick 65; and the vertical axis thereof represents a Grade (G) indicating the degree of the gloss difference between the tip region and its succeeding region. It may be evaluated that with G being smaller, the gloss difference is suppressed (good). In this example, the level giving a slight gloss difference hardly noticeable is set at G=2; the gloss difference with G=2 or less is made permissible.

FIG. 10 uses the oil impregnation quantity in the oil impregnated wick 65 as a substitute of the oil supply quantity. It may be seen that the gloss difference of the image exceeds a permissible level from the vicinity of the region where the oil impregnation quantity exceeds about 3 g. So, it may be seen that the oil impregnated wick 65 is impregnated with a predetermined quantity of oil (about 3 g in this example).

The third structural example intends to reduce the time difference in the nipping zone staying time generated by the following causes.

Specifically, in the case of the sheet P having a certain thickness (e.g. thick sheet of 350 gsm), when its tip enters the roll-nipping zone N1, slippage occurs between the fixing belt 610 (driving roll) with the oil applied on the inner face to reduce a friction coefficient and the surface of the fixing roll 611 (driving roll) so that the speed of the fixing belt 610 is temporarily dropped. As a result, between the tip region passing the nipping zone N with the belt speed reduced and its succeeding region passing the nipping zone N with the belt speed returned to a normal speed, the time difference in the nipping zone staying time is prone to occur.

So, the third structural example is provided with an angle adjusting unit for adjusting the transporting angle of the sheet P transported to the nipping zone N (in this example, realized by the control unit 40), which adjusts the transporting angle of the sheet P so that one of four corners of the sheet P which is thicker than a predetermined reference value first reaches the nipping zone N. Namely, the sheet P is not perpendicularly (from the side of the sheet P) entered the nipping zone N but entered obliquely (from the corner of the sheet P) so that the stress applied to the sheet P by the nipping zone N gradually changes from its entering end (corner). In this way, by reducing the load applied to belt driving to suppress the speed change in the fixing belt 610, the time difference in the nipping zone staying time between the tip region of the sheet P and its succeeding region is decreased. Incidentally, the adjustment of the transporting angle of the sheet P by the angle adjusting unit may be done by controlling the transporting operation of the transporting belt 55 (for example, giving a difference in the transporting speed between the lateral positions in the transporting direction) or otherwise changing the axial angle of the nipping zone (for example, with the members including the fixing belt module 61 and pressurizing roll 62 being on a rotating stand, adjusting the rotating angle of the rotating stand).

The fourth structural example intends to reduce the time difference in the nipping zone staying time generated by the following causes.

Specifically, in the construction in which the oil is supplied to the inner face of the fixing belt 610 in order to reduce the sliding load of the peeling pad 64, if the oil supply becomes excessive or insufficient, the transmission of the driving force from the fixing roll 611 (driving roll) to the fixing belt 610 become instable so that the time difference in the nipping zone staying time is prone to occur.

In order to such inconvenience, the fourth structural example is provided with a driving member for rotation-running the fixing belt 610 as well as the fixing roll 611. Specifically, by additively providing the driving member for the fixing belt 610 at a position not affected by the oil (or a position slightly affected by the oil compared with the fixing roll 611), the speed change of the fixing belt 610 is suppressed thereby to reduce the time difference in the nipping zone staying time between the respective regions of the sheet P (for example, between the tip region and its succeeding region). The driving member other than the fixing roll 611 may be realized in various manners such as using the pressurizing roll 62 which presses the fixing roll 611 through the fixing belt 610; using the stretching roll 615 provided inside the fixing belt 610 on the downstream side of the nipping zone N whose outer surface is made coarse to reduce the slippage due to the oil; or using the stretching roll 613 provided outside the fixing belt 610 on the downstream side of the nipping zone N.

In the explanation hitherto made, the first to fourth structural examples have been proposed individually, but they may be combined with one another as long as control is made so that a time difference in the nipping zone staying time for the unit area between the respective regions of the sheet P (e.g. between the tip region of the sheet and its succeeding region) may be decreased.

It should be noted that on the basis of the mechanism (hypothesis) described above, the tip region in the above explanation is presumably within the length in the transporting direction at a pressure-contact position between the fixing roll and belt pressing member, and the pressurizing roll.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments are chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following claims and their equivalents.

What is claimed is:

1. A fixing device comprising:

a fixing roll that is rotatable;

a belt member that is stretched over the fixing roll;

a pressurizing roll that pressurizes the fixing roll across the belt member;

a belt pressing member that presses an outer surface of the belt member against the pressurizing roll from inside of the belt member on a downstream side at a pressure-contact position between the fixing roll and the pressurizing roll;

a controller that decreases a difference between a passage time per unit area of a leading end region of a recording medium and a passage time per unit area of a succeeding region of the recording medium to pass a pressure-contact portion between the fixing roll, the belt pressing member, and the pressurizing roll; and an oil supplying member that supplies an oil to an inner face of the belt member, wherein the controller includes an oil quantity adjusting unit that adjusts a quantity of the oil so as not to exceed a reference value.

2. A fixing device comprising:

a fixing roll that is rotatable;

a belt member that is stretched over the fixing roll;

a pressurizing roll that pressurizes the fixing roll across the belt member;

a belt pressing member that presses an outer surface of the belt member against the pressurizing roll from inside of the belt member on a downstream side at a pressure-contact position between the fixing roll and the pressurizing roll; and a controller that decreases a difference between a passage time per unit area of a leading end region of a recording medium and a passage time per unit area of a succeeding region of the recording medium to pass a pressure-contact portion between the fixing roll, the belt pressing member, and the pressurizing roll, wherein the controller includes a transporting angle adjusting unit that adjusts a transporting angle of the recording medium thicker than a reference value so that one of four corners of the recording medium first reaches the pressure-contact position.

3. A fixing device comprising:

a fixing roll that is rotatable;

a belt member that is stretched over the fixing roll;

a pressurizing roll that pressurizes the fixing roll across the belt member;

a belt pressing member that presses an outer surface of the belt member against the pressurizing roll from inside of the belt member on a downstream side at a pressure-contact position between the fixing roll and the pressurizing roll; and a controller that decreases a difference between a passage time per unit area of a leading end region of a recording medium and a passage time per unit area of a succeeding region of the recording medium to pass a pressure-contact portion between the fixing roll, the belt pressing member, and the pressurizing roll, wherein the controller includes a driving member other than the fixing roll for rotating the belt member.

* * * * *